US008918924B2

(12) United States Patent
Ton

(10) Patent No.: US 8,918,924 B2
(45) Date of Patent: Dec. 30, 2014

(54) BASIN FOR PEDICURE SPA APPARATUS

(76) Inventor: Quy That Ton, Baton Rouge, LA (US)

( * ) Notice: Subject to any disclaimer, the term of this patent is extended or adjusted under 35 U.S.C. 154(b) by 1229 days.

(21) Appl. No.: 12/171,659

(22) Filed: Jul. 11, 2008

(65) Prior Publication Data

US 2010/0005583 A1 Jan. 14, 2010

(51) Int. Cl.
*A47K 3/024* (2006.01)
*A61H 35/00* (2006.01)

(52) U.S. Cl.
CPC ..... *A61H 35/006* (2013.01); *A61H 2201/10* (2013.01)
USPC ..... 4/574.1; 4/584

(58) Field of Classification Search
CPC ..... A61H 35/006; F21V 33/004
USPC ..... 4/584, 574.1, 622, 541.1–541.6
See application file for complete search history.

(56) References Cited

U.S. PATENT DOCUMENTS

| | | | | |
|---|---|---|---|---|
| 3,585,991 | A * | 6/1971 | Balamuth | 601/157 |
| 4,535,489 | A * | 8/1985 | Elkins | 4/546 |
| 6,412,123 | B1 * | 7/2002 | Lau | 4/541.1 |
| 6,775,863 | B2 * | 8/2004 | Hutchings | 4/541.1 |
| 6,859,953 | B1 * | 3/2005 | Christensen | 4/541.1 |
| 2003/0019028 | A1 * | 1/2003 | Shimizu | 4/541.5 |
| 2005/0120473 | A1 | 6/2005 | Southon | |

FOREIGN PATENT DOCUMENTS

| | | | |
|---|---|---|---|
| DE | 201 05 708 | U1 | 6/2001 |
| EP | 1818038 | A1 | 8/2007 |
| JP | 2001-169949 | A | 6/2001 |

OTHER PUBLICATIONS

Canadian Intellectual Property Office, Office Action dated Mar. 9, 2012 in connection with Application No. 2,675,091 having title, "Basin for Pedicure Spa Apparatus."

* cited by examiner

*Primary Examiner* — Tuan N Nguyen
*Assistant Examiner* — Janie Christiansen
(74) *Attorney, Agent, or Firm* — Minh N. Nguyen; Next IP Law Group LLP

(57) ABSTRACT

Disclosed are various embodiments of systems and methods directed to a pedicure spa apparatus. A pedicure spa can include a basin having an embedded light aperture on a first interior surface of the basin. The embedded light aperture can further includes a light passing layer configured to fluidically seal the embedded light aperture and be substantially seamless with the first interior surface of the basin. The pedicure spa can also include a water agitation device coupled to an interior surface of the basin and a magnetic actuator coupled to an opposing surface of the interior surface.

19 Claims, 4 Drawing Sheets

BASIN FOR PEDICURE SPA APPARATUS

TECHNICAL FIELD

The present invention is generally related to pedicure spas. More specifically, the present disclosure is related to pedicure spas having at least an embedded light and water agitation device.

BACKGROUND

The pedicure industry is expanding in today's economy. A pedicure spa is located in many pedicure salons and many salon professionals are now trained to administer a pedicure to their various clients. Clients sit at the pedicure spa where technicians can provide pedicure services as well as other spa services. Salon professionals or pedicurists render treatment and comfort of the feet of a person in addition to other included services. Prior art pedicure spas may be prone to harbor bacteria and/or other harmful pollutants in the water that may originate from a client's foot or other extremities. Such bacteria or other pollutants may also be introduced into a pedicure spa by a first client and be harbored in the pedicure spa when the apparatus is used by the salon professional to service subsequent clients receiving a pedicure.

Many pedicure spas employ the use of a basin for the purpose of holding water and other features for the comfort of a pedicure client. Bacteria, skin cells and/or other pollutants may leech from a client's feet or other extremities into the water and other parts of the pedicure spa. More specifically, pedicure spas may include one or more lights, heating elements, and/or pumps configured to agitate the water for the further comfort of the client. In order to ensure water-tightness of the tub, gaskets or seals may be employed to protect light bulbs or electrical components of employed pumps from the water. Further, in order to ensure that the pedicure spa is maintainable, these gaskets and/or seals may be removable so that a salon professional may replace light bulbs and/or service and electrical components located within the tub. A gasket and/or seal may be employed with a light bulb housing so that a salon professional may remove the light bulb housing in order to replace a bulb in the event that it requires replacing.

Because water is used in the tub in order to soak a client's extremities, bacteria and/or pollutants may be transmitted or leech into the pedicure spa from a client's extremities via the water used for the pedicure. Subsequently, these pollutants may be harbored within the pedicure spa. Further, such bacteria and pollutants may be harbored around, underneath, or behind the above mentioned gaskets and/or seals that are employed in order to ensure water tightness of the tub. A salon professional may be unable after each use of the tub to thoroughly clean and sanitize these areas of the tub. Such areas may be hidden from convenient access by gaskets and/or seals but still exposed to bacteria or pollutants that may leech into these areas because of the water employed in the pedicuring process.

FIG. 1 depicts a perspective view of a prior art pedicure spa 100, which is also known as a spa basin or pedicure basin. The depicted prior art pedicure spa 100 includes a light and an inlet for a pump agitating water held in the basin 106. The gasket 104 and lighting cover 102 is employed in the depicted prior art pedicure spa 100 in order to ensure water tightness of the basin when water is employed in the pedicuring process by a salon professional. Water may be filled into the basin at or above the vertical position of the light, thereby introducing a risk of water seeping into the electrical components of the light if the integrity of the gasket or seal has been compromised, which can cause a risk of electrocution or failure of the electrical components of the light. Further, it should also be appreciated that bacteria and/or pollutants may seep into the water and exist in, behind, or around the gasket 104.

While a salon professional may clean the basin between uses of the pedicure spa, it should be appreciated that bacteria and/or pollutants existing in and around the gasket and/or seal may not be fully cleansed. It should further be appreciated that over time, the gasket 104 and light cover 102 preventing fluidic communication between the light bulb and the remainder of the basin may decay or lose its structural integrity, creating a risk of water seepage into the electrical components of the light. Such a scenario may create an electrocution hazard or a risk of failure of the electrical components of the light.

The prior art pedicure spa further includes an inlet 110 for a pump that is used to agitate water used in the pedicuring process. Such water agitation increases the comfort of a client receiving a pedicure from a salon professional. The inlet 110 provides access for water to enter a pump that circulates the water, providing the required water agitation. The use of an electric pump in prior art pedicure spas may employ an additional gasket 108 or seal in order to fluidically separate the electrical components of the pump from water in the pedicure spa. Because water is often adjacent to such a seal or gasket, a risk is introduced of water seepage into the electrical components of the pump if the integrity of the gasket or seal has been compromised, which can cause a risk of electrocution or failure of the electrical components of the light. Further, it should also be appreciated that bacteria and/or pollutants may seep into the water and exist in, behind, or around the gasket.

FIG. 2 illustrates an exploded perspective view of a light 112 and light housing 114 employed in the prior art pedicure spa of FIG. 1. Light cover 102 and gasket 104 may extend from an interior surface 115 or wall of the basin 106. Light cover 102 and gasket 104 operate to ensure water tightness from the interior of the basin from the electrical components of the light, including the light 112 and light housing 114. As noted above, bacteria and/or pollutants may seep into the water employed during use of the pedicure spa from a client's extremities and reside in or around the gasket. Such bacteria and/or pollutants may also seep into the water and bypass the gasket and reside in and around the bulb and/or bulb housing.

SUMMARY

Various embodiments of a pedicure spa are disclosed herein. In one embodiment the pedicure spa is made by the steps of fabricating a basin with at least one light aperture. A light passing layer is applied over the light aperture, and the light passing layer is fabricated such that the light passing layer and at least one interior surface of the basin are substantially seamless.

In another embodiment, the pedicure spa includes a basin constructed from at least one chosen from: fiberglass, etc. The pedicure spa further includes an embedded light aperture on a first interior surface of the basin, and a bulb housing coupled to coupled to a first opposing surface of the first interior surface of the basin. The bulb housing is configured to house at least one light bulb. The pedicure spa further includes a magnetic water agitation device configured to agitate water in the basin. The pedicure spa further includes at least one exterior housing configured to house the bulb housing and the magnetic water agitation device. In the embodiment of the pedicure spa, the embedded light aperture further includes a light passing layer that is a resin configured to allow at least a portion of light to pass therethrough. The light passing layer is configured to fluidically separate the embedded light aperture from the basin and be substantially seamless with the first interior surface of the basin. The magnetic water agitation device of the pedicure spa further comprises a water agitation device coupled to a second interior surface of the basin, and a magnetic actuator coupled to an opposing surface of the second interior surface. The magnetic actuator is configured to actuate the water agitation device and is fluidically separated from the water agitation device.

In another embodiment, a pedicure spa can include a basin constructed from at least one chosen from: fiberglass, porcelain, plastics, or other materials used for construction of a basin or spa that should be appreciated. The pedicure spa further includes an embedded light aperture on a first interior surface of the basin. The embedded light aperture further includes a light passing layer, the light passing layer configured to fluidically separate the embedded light aperture from the basin and further configured to be substantially seamless with the first interior surface of the basin.

Other systems, methods, features, and advantages of this disclosure will be or become apparent to one with skill in the art upon examination of the following drawings and detailed description. It is intended that all such additional systems, methods, features, and advantages be included within this description and be within the scope of the present disclosure.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views. While several embodiments are described in connection with these drawings, there is no intent to limit the disclosure to the embodiment or embodiments disclosed herein. On the contrary, the intent is to cover all alternatives, modifications, and equivalents.

DETAILED DESCRIPTION

Figure 1:
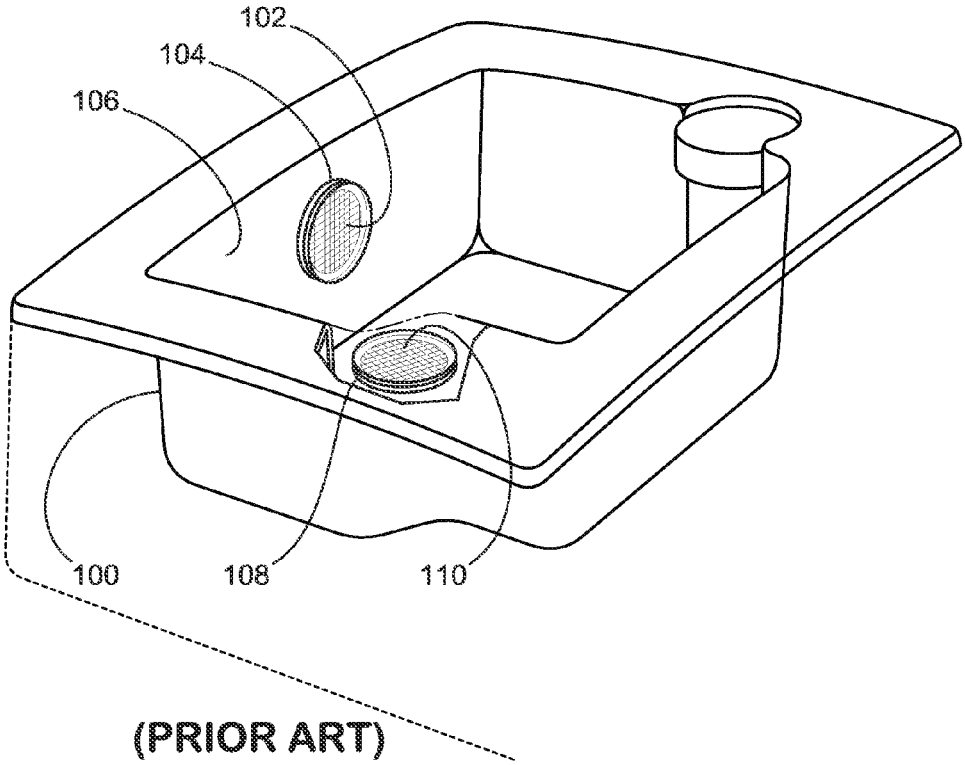
(PRIOR ART) FIG. 1
FIG. 1 depicts a perspective view of a prior art pedicure spa.
Figure 2:
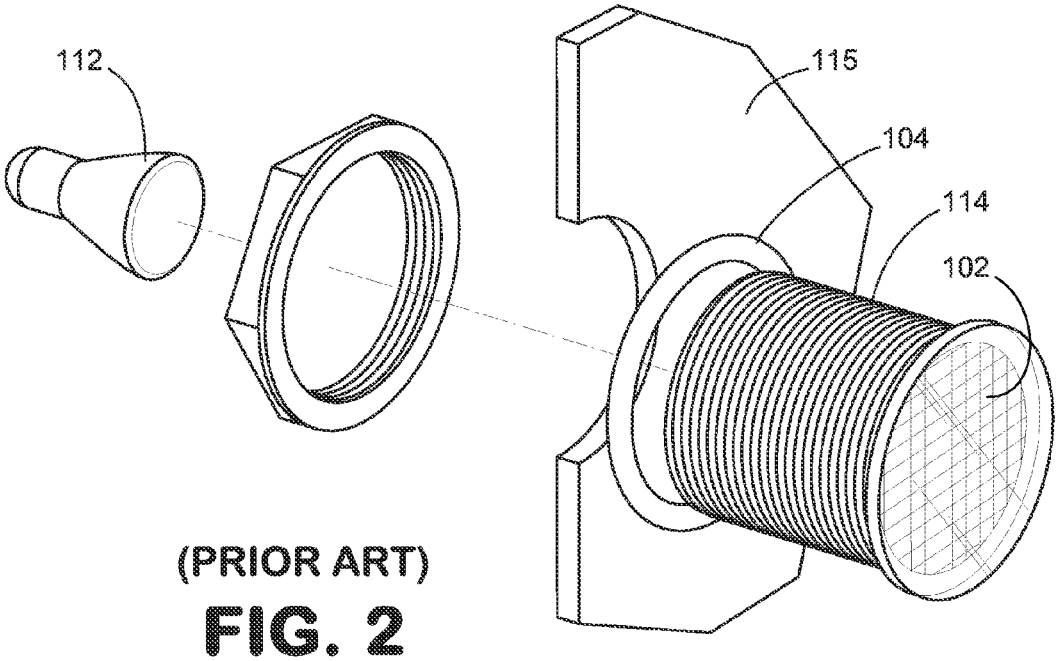
(PRIOR ART) FIG. 2
FIG. 2 depicts an exploded perspective view of the pedicure spa such as that shown in FIG. 1.
Figure 3:
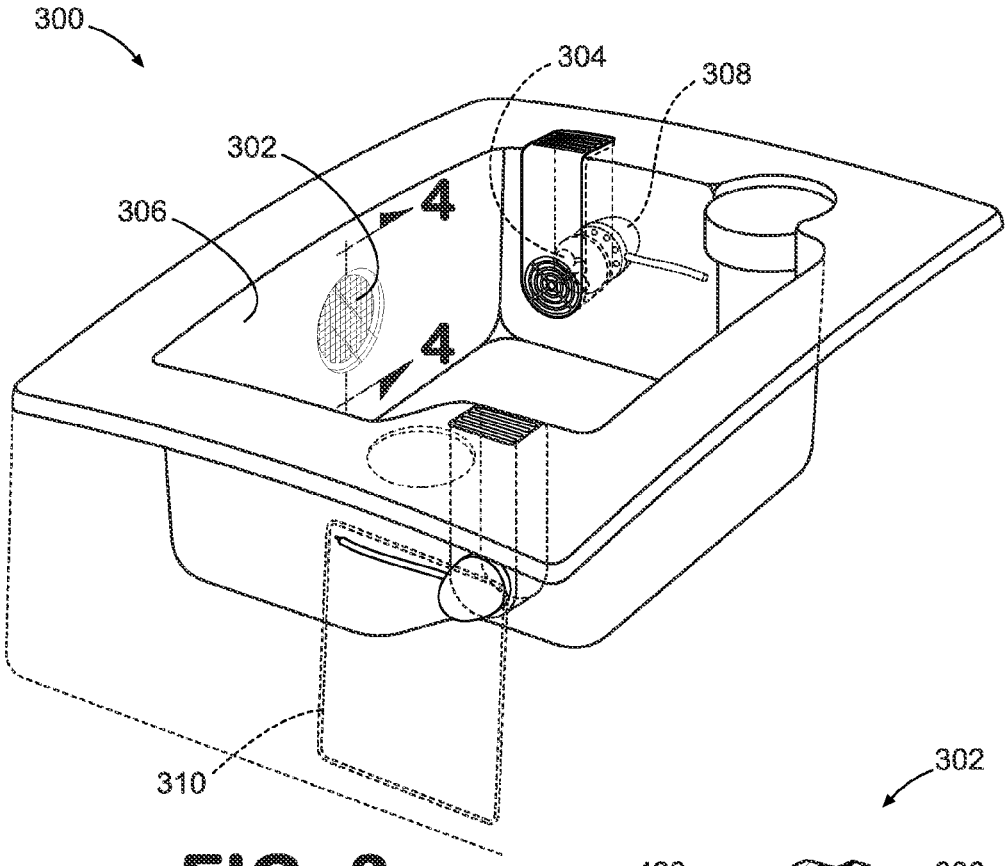
FIG. 3 depicts a pedicure spa in accordance with an embodiment of the disclosure.

FIG. 3 illustrates a perspective view of one embodiment of a pedicure spa 300 having an embedded light 302 and a water agitation device 304. The pedicure spa 300 includes a basin 306 that can comprise various materials including but not limited to: fiberglass, porcelain, plastics, metals, or other materials that should be appreciated for basin or spa construction. The pedicure spa 300 further includes an embedded light 302 and a water agitation device 304. It should be appreciated that the pedicure spa 300 may include one or more of each of the embedded light 302 and water agitation device 304 depending on the requirements of the salon professional and the desires and preferences of clients of the salon professional.

It should further be appreciated that the embedded light 302 can be positioned in various locations within the pedicure spa 300 depending on the requirements of the spa professional or the desires and preferences of clients of the spa professional. In addition, the pedicure spa 300 of FIG. 3 further includes a water agitation device 304. In the depicted embodiment, the water agitation device 304 can incorporate a magnetic pump, which can include, but is not limited to, a magnetic actuator 308 and a water agitation propeller. In the depicted embodiment, the magnetic actuator 308 and be positioned on an opposite surface of the basin 306 relative to the water agitation propeller.

It should also be appreciated that a pedicure spa in accordance with an embodiment of the disclosure may also include various types of pipeless jets, pumps, propellers, impellers, and/or other water agitation devices and that the depicted magnetic pump is but one non-limiting example.

The pedicure spa 300 is also configured with at least one access panel 310 that is configured to provide access to electrical components of the embedded light 302 and the water agitation device 304. For example, a salon professional or maintenance professional may be able to access the bulb housing of the embedded light 302 in order to replace a bulb. Alternatively, one may access the magnetic actuator 308 for maintenance or replacement. It should be appreciated that the depicted access panel 310 is but one configuration and that other configurations or placements can be used. For example, an access door can be positioned adjacent to or near each embedded light 302 or water agitation device 304 employed in a pedicure spa to provide access to each, respectively.

It should be appreciated that the depicted embodiment is but one configuration in accordance with the disclosure and that alternative configurations may be practice in accordance with the subject matter herein. The embodiment of FIG. 3 is discussed in greater detail with reference to FIGS. 4-6.

Figure 4:
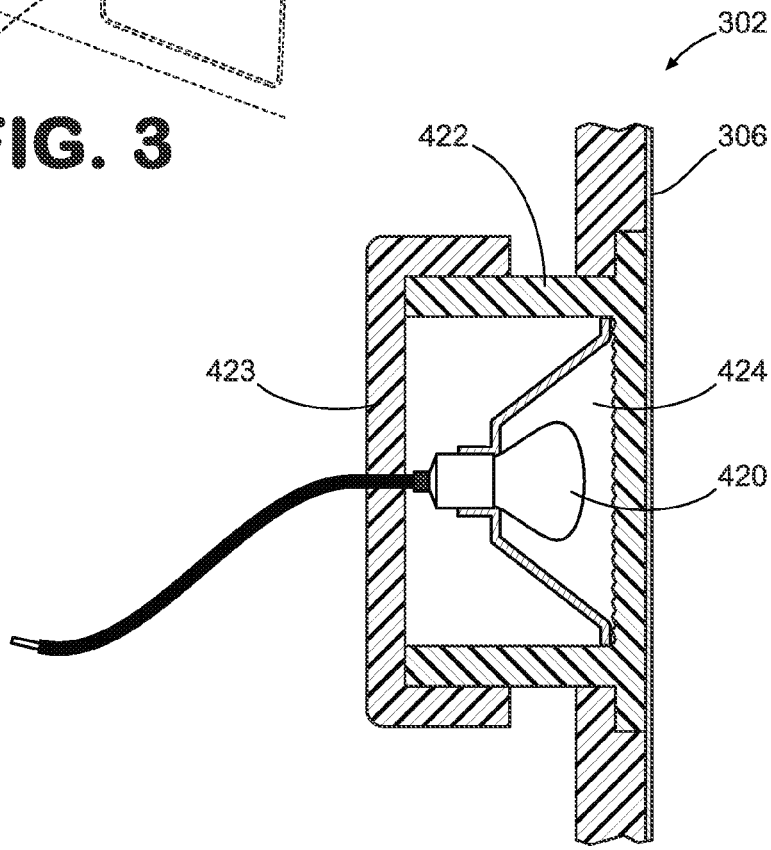
FIG. 4 depicts a cross sectional view of an embedded light of the pedicure spa of FIG. 3.

Reference is now made to FIG. 4, which further illustrates the embodiment of FIG. 3 in accordance with the present disclosure. The cross sectional view of FIG. 4 illustrates the embedded light 302 of FIG. 3, which allows a light to be included in a pedicure spa 300 while reducing the possibility of bacterial harboring and leakage of water into the electrical components of the light. The risk of failure of said components can be due to the use and failure of gaskets, seals, or light covers as in prior art pedicure spas.

The embedded light 302 allows a pedicure spa to be implemented by incorporating a light bulb 420 without the use of a gasket and/or seal in order to prevent fluidic communication between the basin and the electrical components of the light 420. Additionally, the embedded light 302 can be substantially seamless with the interior surface of the basin 306.

The pedicure spa with embedded light 302 prevents fluidic communication between the basin of a pedicure spa 300 when the basin contains water and the light bulb 420 and associated electrical components that can be placed in a bulb housing 422 coupled to a light aperture 424. The light bulb 420 can also be a light emitting diode (LED) lighting system or other light emitting device. The bulb housing 422 can include a cap 423 in order to seal the bulb housing 422 and light bulb 420 in a water tight housing. Accordingly, the light bulb 420 can be sealed by a surface of the basin 306, the bulb housing 422, and the cap 423 through which electrical power can be supplied to the light bulb and/or other electrical components. Accordingly, the electrical components of the light bulb 420 can be placed in a water tight environment while emanating light into the basin 306 through the light aperture 424. Alternatively, a bulb housing 422 can also be configured with a threaded cap or without a cap of any kind.

In accordance with the disclosure, an end of the light aperture 424 can be filled with a light passing layer that is configured to be watertight, the layer of which can include but is not limited to a resin permitting light to pass therethrough or other substantially watertight layer permitting light to emanate. The light passing layer can be further fabricated such that it is substantially seamless with the interior surface of the basin 306. It should further be appreciated that additional applications of the light passing layer can be applied over the aperture and in surrounding areas on the interior surface of the basin. These additional applications may also be fabricated to form a substantially seamless surface that is watertight.

As a result, a salon professional can allow water to fill the basin in order to provide a pedicure to a client and cleanse a substantially seamless basin that can be made without gaskets or seals. In addition, the pedicure spa with embedded light offers salon professional an aesthetically pleasing tub configuration because of its seamless nature. The bulb housing 422 can be affixed to the opposing surface of the interior surface of the spa basin 306, allowing for a light bulb 420 and associated electrical components to be positioned opposite of the light passing layer at one end of the light aperture 424 but in a watertight environment.

Figure 5:
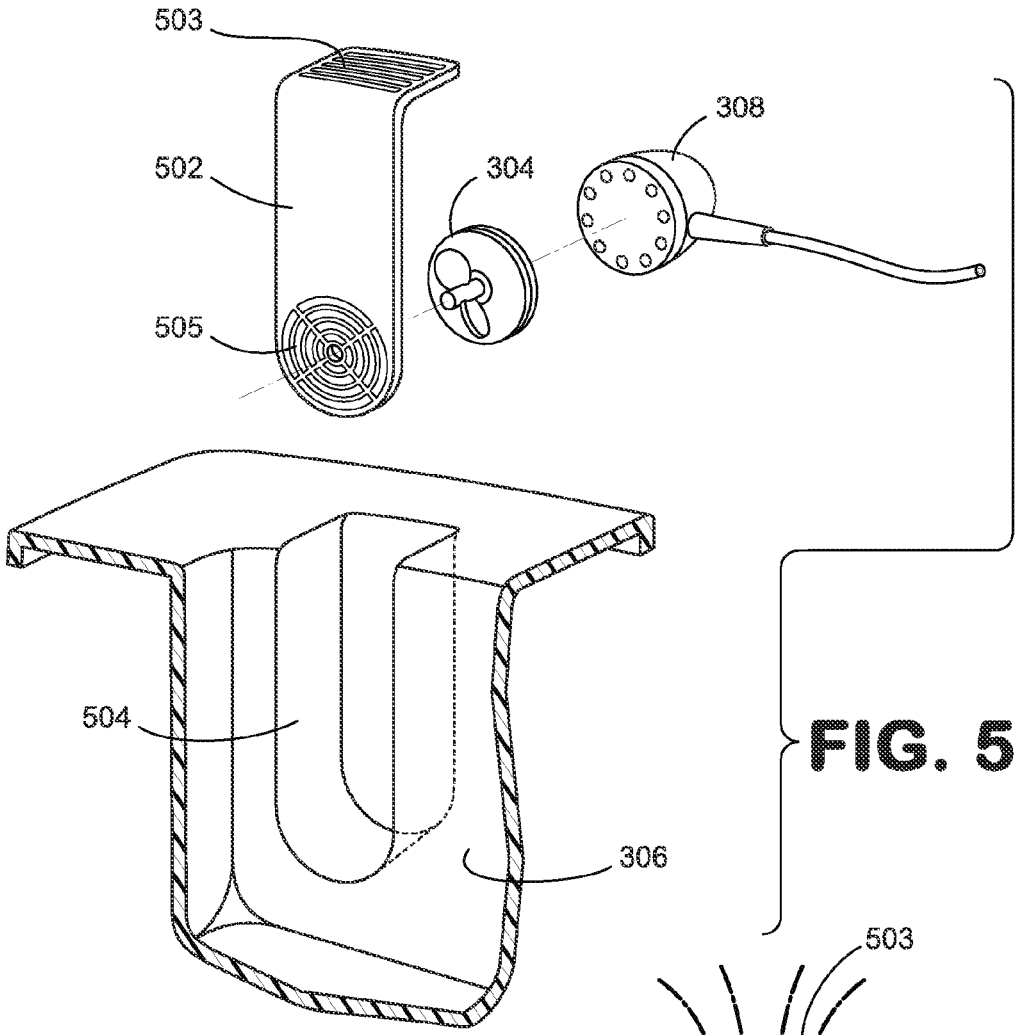
FIG. 5 depicts a water agitation device of the pedicure spa of FIG. 3.

Reference is now made to FIG. 5, which illustrates an alternative view of the embodiment of FIG. 3 in accordance with the present disclosure. FIG. 5 illustrates a water agitation device 304 included into the pedicure spa 300. The water agitation device 304 can be included without the use of a gasket and/or seal for fluidically separating the basin 306 from electrical components of the water agitation device 304. As noted above, pedicure spas often include a pump in order to agitate water used in the basin for the comfort of a client receiving a pedicure.

The water agitation device 304 can operate to agitate water within the pedicure spa. The magnetic actuator 308 can be configured to actuate the water agitation device 304 and that is coupled to an interior surface of the basin 306. Accordingly, the water agitation device 304 agitates water within the basin in response to the magnetic actuator 308 which can be located on an opposing surface of the interior surface. In other words, the magnetic actuator 308 actuates the water agitation device 304 in order to agitate water located within the basin. In this manner, components requiring electricity can be isolated from water in the basin without the use of any gasket or seal.

The water agitation device 304 can be placed in a recess 504 of the basin 306. Accordingly, a pump housing 502 can be placed substantially surrounding the recess 504 and the water agitation device 304. When the basin 306 is filled with water, the magnetic actuator 308 can cause the water agitation device 304 to direct air from the pump housing 502 can direct air from a top vent 503 and through a bottom vent 505 into the basin 306. Therefore, water stored within the basin 306 can be agitated. The pump housing 502 can be configured in various ways, however, it should be appreciated that the pump housing 502 should allow for access to a source of air as well as access to the basin 306, which permits water in the basin 306 to be agitated by the injection of air therein.

The water agitation device 304 and pump housing 502 can be configured to be removable to facilitate cleaning of the basin as well as the water agitation device 308 itself. In addition, as depicted in FIG. 5, the magnetic actuator 308 and water agitation device 304 can be located in a recessed position with a fluidically permeable pump housing 502 allowing agitation of the water in the basin. It should be appreciated that the recessed configuration of FIG. 5 is but one example and that other configurations for placement of the water agitation device 304 and magnetic actuator 308 should be appreciated.

Figure 6:
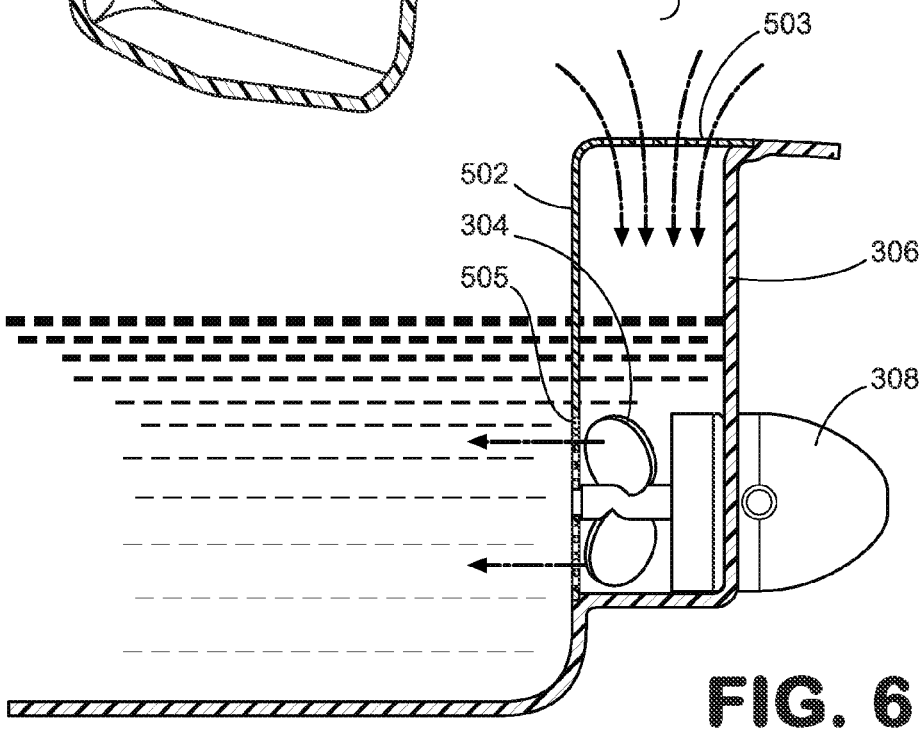
FIG. 6 depicts a cross sectional view of a water agitation device of the pedicure spa of FIG. 3.

FIG. 6 depicts a cross sectional view of the water agitation device 304 and magnetic actuator 308. The water agitation device 304 and magnetic actuator 308 are fluidically separated by an interior surface of the basin 306. Accordingly, the magnetic actuator 308 can be electrically powered but also be fluidically separated from the basin 306 of the pedicure spa 300. It should be appreciated that the magnetic actuator 308 can be electrically powered and cause the water agitation device 304 to agitate water within the pedicure spa 300.

Figure 7:
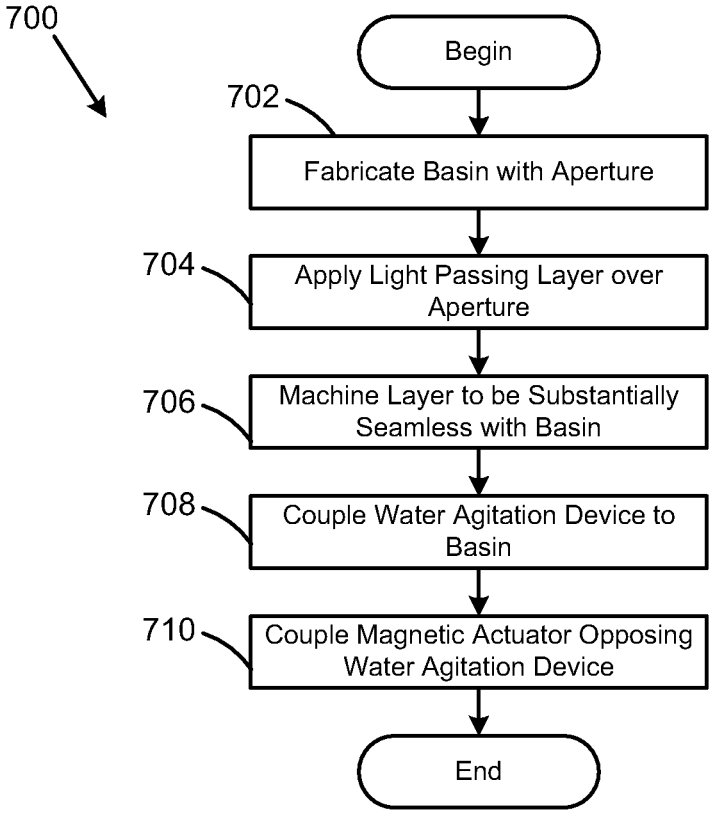
FIG. 7 depicts flowchart illustrating a method in accordance with the disclosure.

FIG. 7 depicts a flowchart illustrating a method 700 of making a pedicure spa in accordance with the disclosure. In step 702, a basin having a light aperture is fabricated. The light aperture can provide an aperture for a light positioned therein to emanate light into the basin. In step 704, a light passing layer can be applied at least over the aperture. The light passing layer can include a resin or other similar material that permits light to emanate through the light passing layer and into the basin. In step 706, the light passing layer can be fabricated or smoothed such that the light passing layer is substantially seamless relative to the interior or other surfaces of the basin. In this way, a light bulb, which can be electrically powered, can be positioned adjacent to the light aperture sealed by the light passing layer, allowing the electrical components of the light to be fluidically separated from the interior of the basin.

In step 708, a water agitation device is coupled to an interior surface of the basin. As noted above in reference to the embodiment of FIG. 3, a water agitation device can be configured to agitate water stored within the basin of a pedicure spa for the comfort of a person receiving a pedicure. In step 710, a magnetic actuator is coupled to an opposing surface of the interior surface to which the water agitation device is coupled. As noted above, the magnetic actuator can be fluidically separated from the water agitation device by a wall or surface of the basin.

Although the flow chart of FIG. 7 shows a specific order of execution, it is understood that the order of execution may differ from that which is depicted. For example, the order of execution of two or more blocks may be scrambled relative to the order shown. Also, two or more blocks shown in succession in FIG. 7 may be executed concurrently or with partial concurrence. In addition, any number of counters, state variables, warning semaphores, or messages might be added to the logical flow described herein, for purposes of enhanced utility, accounting, performance measurement, or providing troubleshooting aids, etc. It is understood that all such variations are within the scope of the present disclosure.

It should be emphasized that the above-described embodiments are merely possible examples of implementations, merely set forth for a clear understanding of the principles of this disclosure. Many variations and modifications may be made to the above-described embodiment(s) without departing substantially from the spirit and principles of the disclosure. All such modifications and variations are intended to be included herein within the scope of this disclosure.

One should also note that conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more particular embodiments or that one or more particular embodiments necessarily include logic for deciding, with or without user input or prompting, whether these features, elements and/or steps are included or are to be performed in any particular embodiment.

Therefore, at least the following is claimed:

1. A pedicure spa, comprising:

a basin constructed from at least one chosen from: fiberglass, porcelain, steel, and plastic;

an embedded light aperture placed on a first interior surface of the basin, wherein the embedded light aperture further includes a light passing layer configured to fluidically seal the embedded light aperture without the use of a gasket and/or seal and further configured to be substantially seamless with the first interior surface of the basin;

a bulb housing including sidewalls that adheres to the basin and is configured to house at least one light bulb, wherein the sidewalls of the bulb housing is coupled substantially over the embedded light aperture to a first opposing surface of the first interior surface of the basin;

a water agitation device configured to agitate water in the basin;

a recess that is positioned on an inner surface of the basin and having at least one side wall, wherein at least one edge of the at least one side of the recess is integrally formed as part of the inner surface of the basin, wherein the water agitation device is placed therein, wherein the water agitation device is coupled to the recess of the basin and is designed to be removable from the recess;

a cover that covers the recess and has perforations to allow agitated water to move from the recess to the interior of the basin, wherein the cover is designed to be removable from the recess;

a magnetic actuator coupled to an opposing surface of the recess, wherein the magnetic actuator is configured to actuate the water agitation device and is fluidically separated from the water agitation device; and a housing configured to house the bulb housing and the magnetic actuator, the exterior housing having at least one access panel configured to provide access to the bulb housing.

2. A pedicure spa, comprising:

a basin composed of at least one of: fiberglass, porcelain, plastic and steel;

an embedded light aperture placed on a first interior surface of the basin;

a light passing layer that is applied over the embedded light aperture and adheres to the basin and the bulb housing to fluidically seal the embedded light aperture and allow light to pass from the embedded light aperture through the light passing layer;

a recess that is positioned on an inner surface of the basin and having at least one side wall, wherein at least one edge of the at least one side of the recess is integrally formed as part of the inner surface of the basin, wherein on the basin in which a water agitation device can be placed therein, wherein the water agitation device is configured to agitate water in the basin and is designed to be removable from the recess; and a cover that covers the recess and has perforations to allow agitated water to move from the recess to the interior of the basin, wherein the cover is designed to be removable from the recess.

3. The pedicure spa of claim 2, wherein the light passing layer is a resin configured to permit light to pass therethrough.

4. The pedicure spa of claim 2, further comprising a bulb housing including sidewalls that adheres to the basin and is configured to house at least one light bulb, wherein the sidewalls of the bulb housing is coupled substantially over the embedded light aperture to a first opposing surface of the first interior surface of the basin.

5. The pedicure spa of claim 4, wherein at least one light bulb is positioned within the at least one bulb housing.

6. The pedicure spa of claim 5, further comprising an exterior housing configured to house the bulb housing.

7. The pedicure spa of claim 6, wherein the exterior housing is configured with at least one access door to provide access to the bulb housing.

8. The pedicure spa of claim 2, further comprising: a water agitation device placed in the recess of the basin; and an actuator coupled to an opposing surface of the recess, wherein the actuator is configured to actuate the water agitation device and is fluidically separated from the water agitation device.

9. The pedicure spa of claim 8, wherein the water agitation device further comprises at least one of: a propeller and an impeller.

10. The pedicure spa of claim 8, wherein the actuator further comprises a magnetic actuator configured to magnetically actuate the water agitation device.

11. A basin, comprising:

a first interior surface of the basin;

an embedded light aperture placed on the first interior surface of the basin;

a light passing layer that is applied over the embedded light aperture and adheres to the first interior surface of the basin to fluidically seal the embedded light aperture and allow light to pass from the embedded light aperture through the light passing layer;

a recess that is positioned on an inner surface of the basin and having at least one side wall, wherein at least one edge of the at least one side of the recess is integrally formed as part of the inner surface of the basin, wherein a water agitation device can be placed therein, wherein the water agitation device is configured to agitate water in the basin and is designed to be removable from the recess; and a cover that covers the recess and has perforations to allow agitated water to move from the recess to the interior of the basin, wherein the cover is designed to be removable from the recess.

12. The basin of claim 11, wherein the light passing layer is a resin configured to permit light to pass therethrough.

13. The basin of claim 11, further comprising a bulb housing including sidewalls that adheres to the basin and is configured to house at least one light bulb, wherein the sidewalls of the bulb housing is coupled substantially over the embedded light aperture to a first opposing surface of the first interior surface of the basin.

14. The basin of claim 13, wherein at least one light bulb is positioned within the at least one bulb housing.

15. The basin of claim 14, further comprising an exterior housing configured to house the bulb housing.

16. The basin of claim 15, wherein the exterior housing is configured with at least one access door to provide access to the bulb housing.

17. The basin of claim 11, further comprising: a water agitation device placed in the basin; and an actuator coupled to an opposing surface of the recess, wherein the actuator is configured to actuate the water agitation device and is fluidically separated from the water agitation device.

18. The basin of claim 17, wherein the water agitation device further comprises at least one of: a propeller and an impeller.

19. The basin of claim 17, wherein the actuator further comprises a magnetic actuator configured to magnetically actuate the water agitation device.

* * * * *